United States Patent [19]

Vermette

[11] 3,957,137

[45] May 18, 1976

[54] PORTABLE MATERIAL LIFT

[76] Inventor: Howard H. Vermette, No. 7 - 143rd St., Hammond, Ind. 46320

[22] Filed: June 30, 1975

[21] Appl. No.: 591,520

Related U.S. Application Data

[63] Continuation of Ser. No. 450,444, March 12, 1974, abandoned.

[52] U.S. Cl. ..... 187/11; 187/1 R; 187/2

[51] Int. Cl.[2] ..... B66B 9/20

[58] Field of Search ..... 187/2, 9 R, 1 R, 10, 187/11, 12, 13, 14, 27; 182/141, 142; 248/167, 188.6; 24/136 K; 254/4 R, 4 B, 4 C; 212/145, 8, 9

[56] References Cited

UNITED STATES PATENTS

| | | | |
|---|---|---|---|
| 182,380 | 9/1876 | Miller | 187/11 |
| 453,457 | 6/1891 | Albro | 187/27 |
| 1,799,307 | 4/1931 | Manley | 187/11 |
| 2,196,634 | 4/1940 | Kuert | 187/11 |
| 3,312,432 | 4/1967 | Pfeiffer et al. | 248/188.6 X |
| 3,385,401 | 5/1968 | Campbell et al. | 187/11 |
| 3,587,892 | 6/1971 | Vermette | 187/11 X |
| 3,752,261 | 8/1973 | Bushnell | 182/141 X |
| 3,807,575 | 4/1974 | Merrick | 212/8 R |

*Primary Examiner*—Evon C. Blunk
*Assistant Examiner*—James L. Rowland
*Attorney, Agent, or Firm*—Max R. Kraus

[57] ABSTRACT

A portable material lift comprising a base and a vertical post supported thereon, which post is formed of a plurality of sections coupled together, a pulley housing at the top of the vertical post for supporting a pulley, a winch supported on the post between the pulley housing and base, a load supporting platform slideably supported on the post, a cable connected to the winch and extending over the pulley and connected to the platform for moving said platform with a load vertically with respect to said post, and an outrigger secured to the base to extend laterally of said base.

6 Claims, 15 Drawing Figures

10
12
14
16
18
20
22
24
26
28
30
32
33
34
35
36
38
39
42
43
44
45
46
55
59
62
64
65
66
68
69
70
72
73
74
76
78
80
81
82
83
84
L
S
3
4

PORTABLE MATERIAL LIFT

This is a continuation of application Ser. No. 450,444, filed Mar. 12, 1974, now abandoned.

BRIEF SUMMARY OF THE INVENTION

One of the objects of this invention is to provide a material lift provided with an outrigger for stabilizing same.

Another object of this invention is to provide a material lift with a pulley housing having a pair of pulleys, with one of the pulleys in substantial vertical alinement with the vertical post and the other spaced rearwardly of the post to form a rearwardly extending cantilever and over which the cable from the winch to the movable load lift platform extends, which forms a cantilever force at the rear to counterbalance the force at the front produced by the lifted load.

Another object of this invention is to provide a material lift in which a pulley housing is provided at the top of the vertical post which extends rearwardly of the vertical post so that tensioned guy wires extending between it and the outrigger provide a cantilever force to counterbalance the raised load.

Another object of this invention is to provide an outrigger which is pivotally movable with respect to the base.

Another object of this invention is to provide a pulley housing having means which will receive a cross-member to extend through said housing to permit attachment of scaffolding and the like.

Another object of this invention is to provide a material lift in which the vertical post or upright is made of sections detachably secured and in which the vertical post may be made of any desired height.

BRIEF DESCRIPTION OF THE DRAWINGS

In the drawings:

FIGS. 1 THROUGH 7

Figures 1, 2, 3:
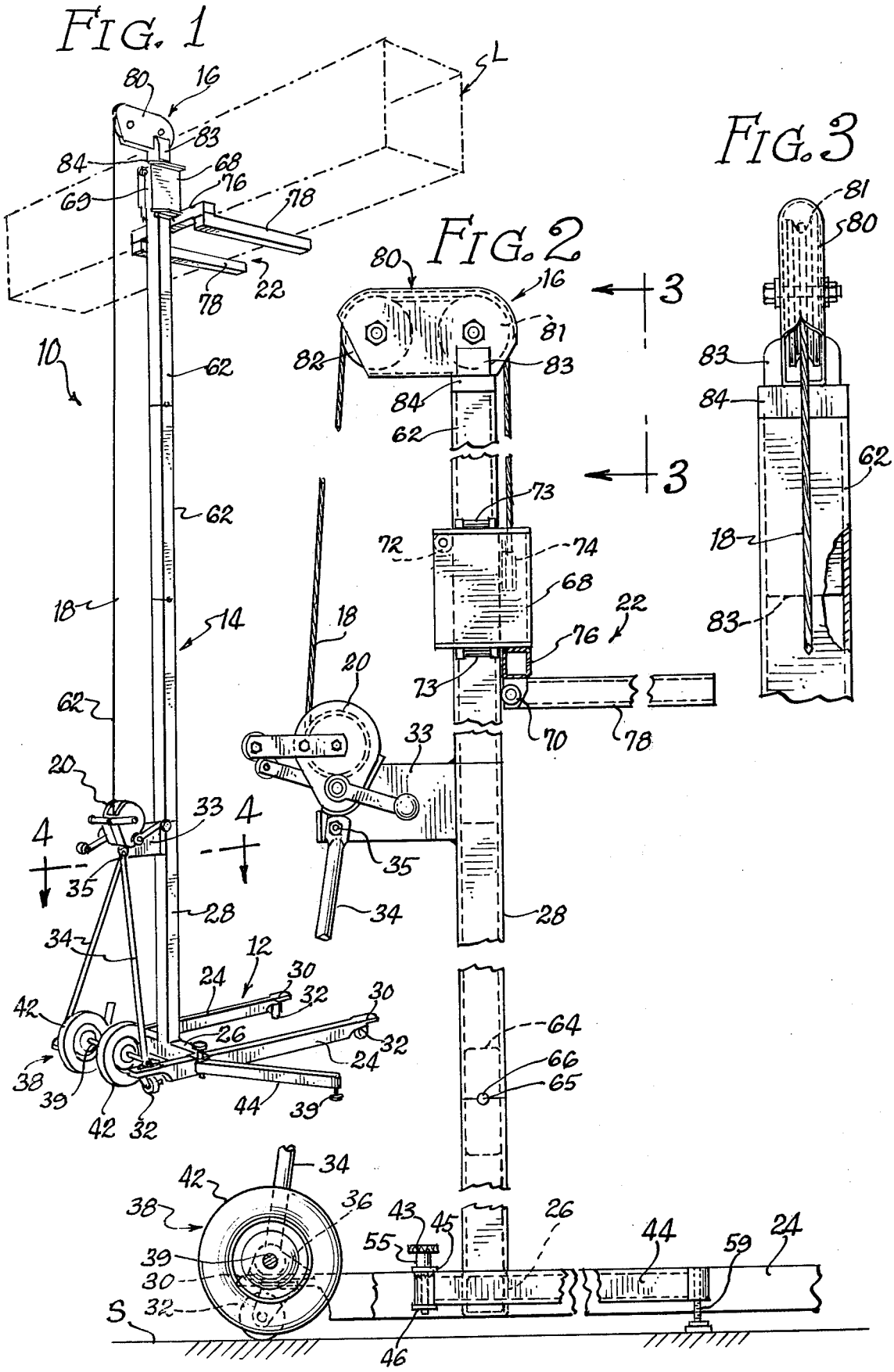
FIG. 1 is a perspective view of one embodiment of this invention.
FIG. 2 is a side elevational view of FIG. 1 with a portion broken away.
FIG. 3 is a view taken on line 3—3 of FIG. 2.
Figure 4:
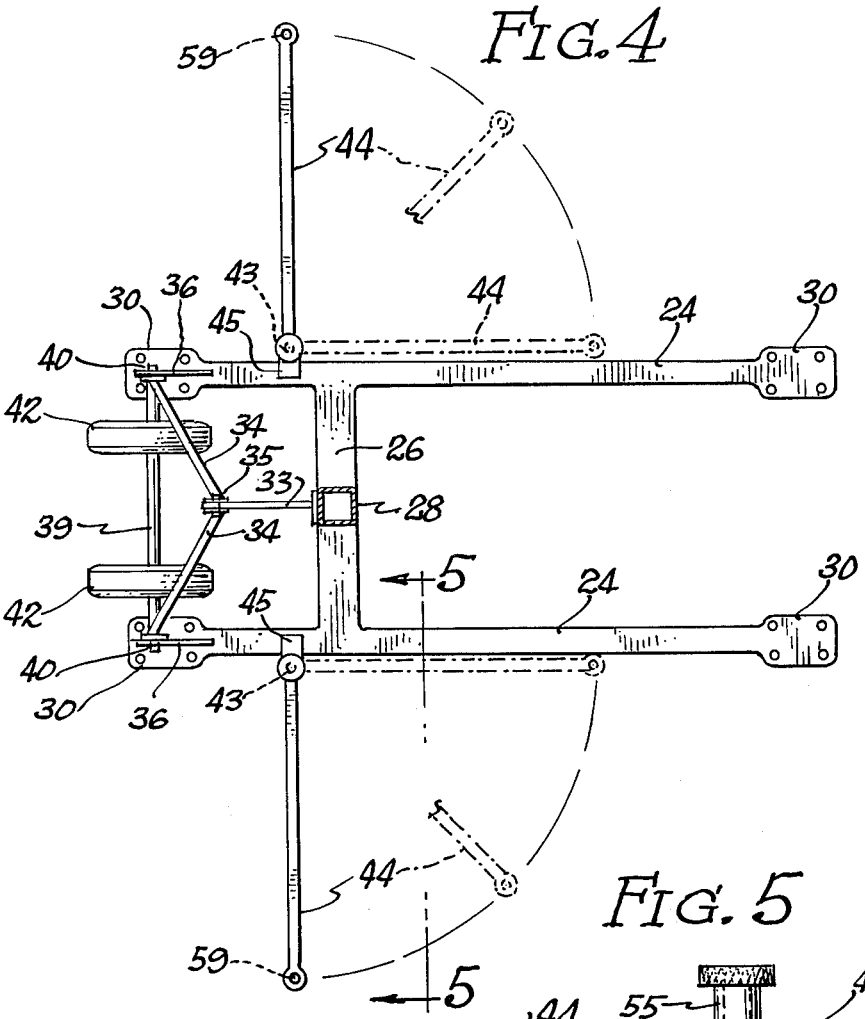
FIG. 4 is a view taken on line 4—4 of FIG. 1 showing a top plan of the base with the adjustable outriggers adjusted in their outermost supporting position.

The lift shown in FIGS. 1 through 7 is indicated generally at 10 and the parts forming same are formed preferably of steel for strength. Briefly and generally described, the lift comprises a base 12 which supports an upright or post 14 which is formed of a plurality of tubular sections which are detachably interlocked. Supported on the top of the upright or post 14 is a pulley unit generally indicated at 16, having a pair of pulleys over which runs a cable 18, with one end of the cable connected to a winch 20 supported on the lowermost section of the post and with the opposite end of the cable connected to a vertically movable platform generally indicated at 22 which upon actuation of the winch is adapted through the cable to move the platform up and down relative to the post to raise and lower the load L carried on the platform.

More specifically, the base 12 comprises a pair of spaced side members 24 connected by a cross-member 26 which is positioned inwardly of the rear ends of the side members. The cross-member 26 centrally supports a vertical section 28 which is a square-shaped tubular member and ultimately forms the lowermost portion of the vertical post 14. The front and rear ends of the side members 24 have plates 30 to the underside of which are mounted swivel casters generally indicated at 32 whereby the entire lift may be rolled on a floor or ground surface.

Fixedly mounted as by welding on the lowermost section 28 of the post is a rearwardly extending plate 33 to which the conventional winch 20 is fixedly secured. The winch is provided with the conventional pair of handles which when rotated rotates the winch pulley through conventional means within the winch. The winch pulley has one end of the cable 18 attached thereto. As stated, winch 20 is of conventional construction and the two handles work in unison for operating same. It has a self-energizing brake which automatically takes over and locks the platform and load thereon in any elevated position. Reversing the conventional control handle releases the brake and allows the platform and load to descend under full control. As the winch is of conventional commercial construction, the details thereof form no part of this invention.

To additionally support the winch there is provided a pair of winch braces 34 which are secured at their upper end as at 35 to the rearwardly extending plate 33, with the lower end of each said brace secured to an upstanding anchoring plate 36 which is fixedly secured to the plate 30 of each side member 24. These bracing members are positioned so that they are inclined outwardly from the top toward the bottom.

Secured to the rear of the base 12 is a wheel and axle assembly generally indicated at 38 which comprises an axle 39 which is secured at its opposite ends as at 40 to the upstanding anchoring plates 36 on the side members 24. The axle supports a pair of spaced wheels 42 which extend rearwardly of the cross-member 26 and between the rear ends of the spaced side members 24 of the base. As will be seen, the wheel and axle assembly is positioned substantially below the winch and rearwardly thereof and provides a support for the base and the lift unit. As best seen in FIG. 2, in normal position the wheels 42 are spaced upwardly and clear of the floor or ground surface S so that the casters 32 support the base 12 so that the unit may be rolled on the casters. If however it is desired to move the unit a substantial distance then the entire lift unit can be tilted rearwardly so that the wheels 42 engage the ground or floor surface S and in this tilted position the entire unit can be moved on said wheels 42.

Secured to each of the side members 24 of the base 12 is a pivotally mounted adjustable outrigger, each generally indicated at 44 and best shown in detail in FIGS. 4 to 7 inclusive. Each adjustable outrigger is pivoted or movable manually from a position shown in dotted lines adjacent each of the sides 24 to a 90° angle shown in full lines in FIG. 4, where it lies perpendicular to the longitudinal axis of the two side members 24 of the base. They can likewise be positioned anywhere within the arc intermediate these two points and may also be pivoted rearwardly of the perpendicular position shown in FIG. 4.

Figure 5:
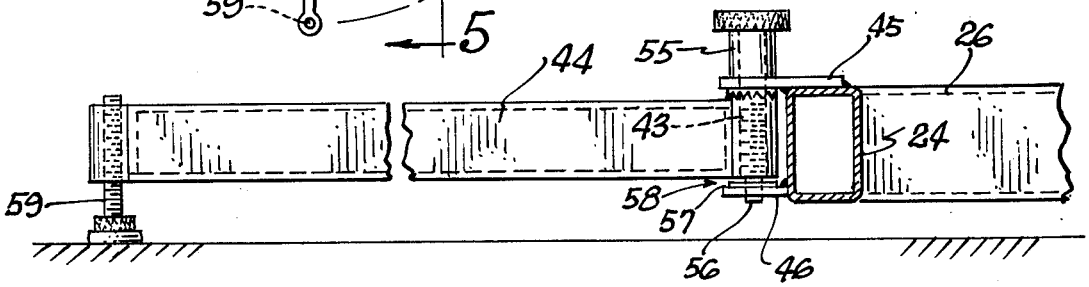
FIG. 5 is a view partially in section taken on line 5—5 of FIG. 4.
Figure 7:
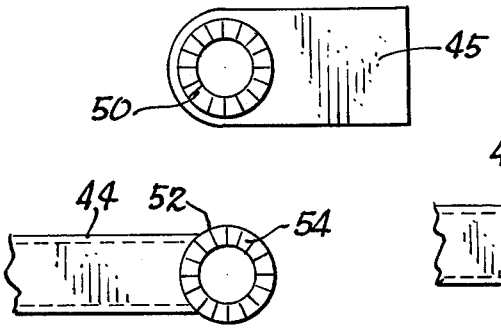
FIG. 7 is an exploded view of certain of the interengaging parts of FIG. 6.
Figure 6:
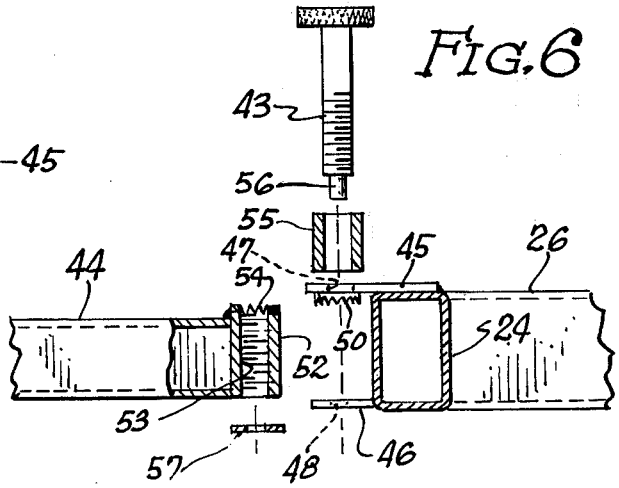
FIG. 6 is an exploded view of the parts of FIG. 5.

The spaced side members 24 of the base are of hollow tubular construction of generally rectangular shape in cross-section, as best shown in FIGS. 5 and 6. Fixedly secured as by welding to the top and bottom of each side member 24 are laterally extending ears. The top ear is designated at 45 and the bottom ear at 46 and each is provided with a centrally alined opening 47 and 48 respectively. The underside of the top ear 45 is provided with a serrated surface 50 whereas the top surface of the bottom ear 46 is generally smooth. The inner end of the adjustable outrigger has a cylindrical-shaped end 52 which is internally threaded as at 53 and with the top annular surface thereof provided with a serrated surface 54 which engages with the serrated surface 50 of the upper ear 45. The outrigger 44 is positioned so that the cylindrical end 52 fits between the spaced ears 45 and 46 on the base. A spacer or sleeve 55 is positioned on the top ear 45 and an externally threaded fastening element 43 having a head at the top is inserted to extend through the spacer 55, the alined ears 45 and 46 and the cylindrical portion 52 of the outrigger, with the threaded fastening element 43 engaging the threaded cylindrical portion 52. The lower end of the fastening member has a reduced shank 56 on which a washer 57 is secured. A space 58, best shown in FIG. 5, is provided between the bottom of the outrigger 44 and the washer 57.

The pivotally movable outrigger 44 may be moved and pivoted relative to the sides 24 of the base and may be locked in any of its pivoted or adjusted positions by rotating the fastening element 43 clockwise which causes the serrated surface 50 of the top ear 45 and the serrated top surface 54 of the cylindrical portion 52 to interengage as they are urged toward each other by the threaded fastening member 43 engaging the threads of the cylindrical portion 52. This serves to maintain the outrigger locked in its pivoted adjusted position. The adjustable outrigger may be pivoted after the fastening screw 43 is rotated counterclockwise so that the two serrated surfaces are not brought into close engagement. The outer end of the outrigger 44 supports an adjustable leg 59. The pivotal outriggers may be positioned as shown in dotted lines in FIG. 4, adjacent to and parallel with the sides 24 of the base, in which position the outriggers are in an out-of-the-way position and they may be moved to extend 90° as shown in full lines in FIG. 4, perpendicular to the sides, or they may even be moved and pivoted rearwardly to other positions. The maximum outrigger support is when they are extended approximately 90° as shown in full lines in FIG. 4.

The height of the upright or post 14 is determined by the number of post sections 62 which are secured to form the vertical post. Each post section 62, including the lowermost post section 28, is square-shaped and tubular in cross-section and these post sections 62 are detachably coupled or detachably connected together by means of short connectors 64 which are likewise tubular members of square-shape in cross-section but of a reduced diameter (see FIG. 2). The connectors 64 are inserted inside two adjacent post sections. The connectors 64 carry oppositely extending studs or pins 65 which engage alined notches 66 in the ends of the post sections. The studs or pins 65 and notches 66 therefore position the connectors between two adjacent post sections and maintain the post sections coupled together to form a post of the desired height.

Slideable Platform

The platform unit generally indicated at 22 includes a carriage 68 which is slideable on the upright or post 14 and said carriage surrounds the post but is provided with a split 69 on the rear side so as not to interfere with the winch support plate 33. The carriage 68 has front and rear guide rollers 70 and 72 and spaced side guide rollers 73 which engage the post. One end of the which cable 18 is secured to the interior of the carriage by a wedge lock, as indicated at 74. Said securement is through a wedge lock which is similar to the wedge lock more clearly shown in FIG. 9 in connection with the modified structure. Fixedly secured to the carriage 68 is a transversely extending member 76 with spaced forwardly extending side arms 78 which extend below the plane of the transverse member 76. The load L to be lifted is supported on the arms 78, as seen in FIG. 1.

Top Pulley Unit

Figure 9:
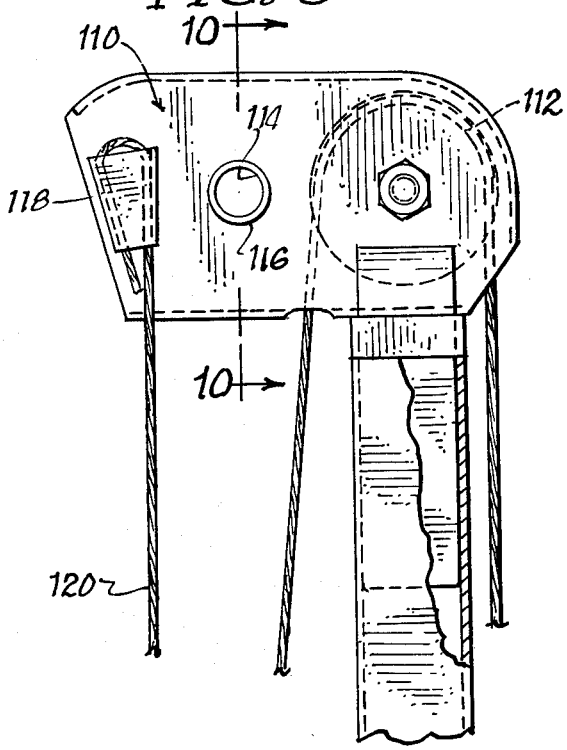
FIG. 9 is a side elevational view partially in section of the upper portion of FIG. 8.

A pulley unit generally indicated at 16 and best shown in FIGS. 1, 2 and 3, is detachably secured to the top of the uppermost section 62 of the post 14. Said pulley unit comprises a housing 80 which supports a pair of spaced pulleys 81 and 82. Said housing is connected to the post by means of a coupling tongue 83 which is fixedly secured to housing 80 but extends vertically downward therefrom, which is of tubular construction and is adapted to telescope within the similarly shaped tubular end of the post section 62 and thereby detachably secures the pulley housing to the post. A similar arrangement is best shown in FIG. 9 in connection with a modified pulley housing. The coupling tongue 83 has a shoulder 84 which abuts against the edge of the post section to limit the insertion of the coupling tongue into the post section. When the pulley unit is secured to the post, as best seen in FIG. 2, the front pulley 81 is in vertical alinement with the post whereas the rear pulley 82 is positioned rearwardly thereof. The winch cable 18 which is connected at one end to the winch 20 passes over both pulleys 82 and 81 and extends downwardly and is connected through the wedge lock 74 in the carriage 68. As best seen in FIG. 2, the portion of the cable extending from the pulley 82 to the winch 20 is at an inclined angle and provides a cantilever force since the pulley housing and the two pulleys at the top of the post form a cantilever with respect to the post.

The operation of the foregoing structure will be readily apparent. By manually operating the handles of the winch 20 the cable 18 is either wound into or out of the winch, depending upon rotation of the handles and as the cable is wound into the winch it will cause the carriage 68 of the platform unit 22 to slide up on the post 14 and move the platform 22 upwardly to lift the load. Rotating the handles of the winch in the opposite direction will let out the cable from the winch and will permit the carriage and platform to descend on the post. Thus the platform 22 may be raised and lowered on said post to lift or lower the load supported thereon.

FIGS. 8 through 15

The modified construction shown in FIGS. 8 through 15 inclusive will now be described.

In the modified construction the base, vertical post, sliding platform and the carriage are similar to that previously described and the parts will be given the same numbers but primed and will not be redescribed. The differences in the modification are that the post 14' is higher than the post 14 and is formed of a greater number of interconnected post sections 62' and that the base 12' is longer than base 12. Also, the wheel and axle assembly 38 heretofore described is eliminated. In this modification a stationary outrigger is used and the pulley housing supports a single pulley with guy wires extending between the rear of the pulley housing and the stationary outrigger.

The stationary outrigger generally indicated at 86 comprises a pair of members 87 and 88 which are adapted to be secured to the base and to extend transversely thereof and laterally of the sides 24' of the base adjacent the front and rear. The rear cross-member 88 of the stationary outrigger is formed of tubular stock square-shaped in cross-section and is provided with spaced openings 89 along the four sides thereof. It is provided with adjustable legs generally indicated at 90 at the opposite ends thereof, best shown in FIG. 15, which is comprised of an externally threaded rod 91 with a rubber foot 92. The rear cross-member 88 has welded to it at the bottom a threaded nut 93 adjacent one of the openings 89 with which the rod 91 is in threaded engagement. Wing nuts 94 are mounted on the rod. The height of the leg relative to the cross-member 88 may be adjusted. The front cross-member 87 is provided with similar adjustable legs indicated generally at 90'.

Extending across the rear cross-member 88 is a bow-shaped strut member 95 of tubular construction whose opposite ends are welded as at 96 to the top of cross-member 88 and is supported intermediate the ends by spaced vertical ribs 97 welded to the cross-member 88 and bow-shaped strut 95. To secure the rear cross-member 88 to the spaced sides 24' of the base are a pair of brackets each generally designated at 98, best shown in FIGS. 12 and 13, which comprises an upper U-shaped member 99 and a lower inverted U-shaped member 100 fixedly secured as by welding to the upper member but disposed at right angles thereto. Upper member 99 engages the cross-member 88 with a fastening bolt 102 passing through alined openings 103 in the sides thereof and through alined openings 89 in the cross-member 88 to detachably lock the bracket 98 to the cross-member 88. The bottom inverted U-shaped member 100 fits over the spaced side member 24' of the base and is secured thereto by a fastening bolt 105 extending through alined openings in the sides of the bracket and through suitable alined openings provided in the opposite sides of side members 24' of the base.

The front cross-member 87 of the stationary outrigger is secured to the spaced sides 24' of the base by similar brackets indicated at 98'. These brackets may be readily removed from the cross-members 87 and 88 and the sides of the base to permit the mounting and dismounting of the outriggers with respect to the base. Secured to the rear cross-member 88 adjacent the opposite ends are eye bolts generally indicated at 107, best seen in FIG. 14. A threaded nut 108 is alined with the bottom opening in the cross-member and welded thereto and the threaded eye bolt 107 which extends through the openings in the cross-member is in engagement with the nut 108 for adjusting the eye bolt.

Figure 8:
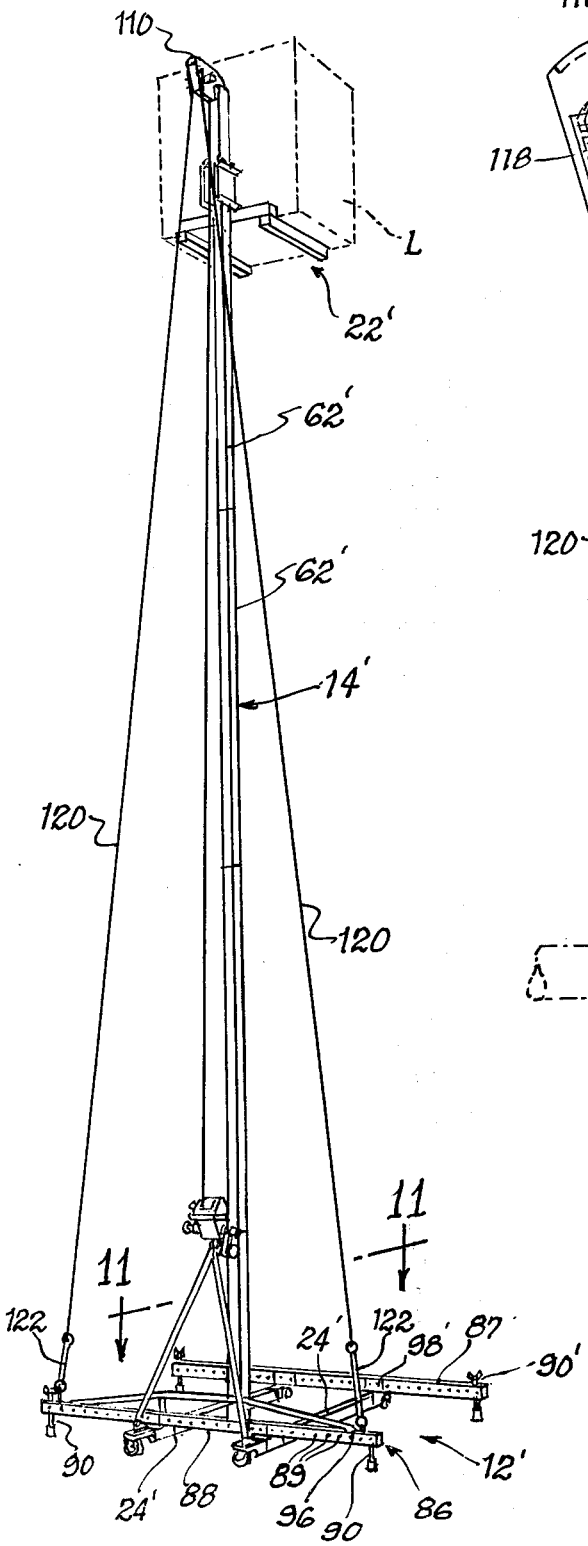
FIG. 8 is a perspective view showing a modification utilizing stationary outriggers where a higher post is used.
Figure 10:
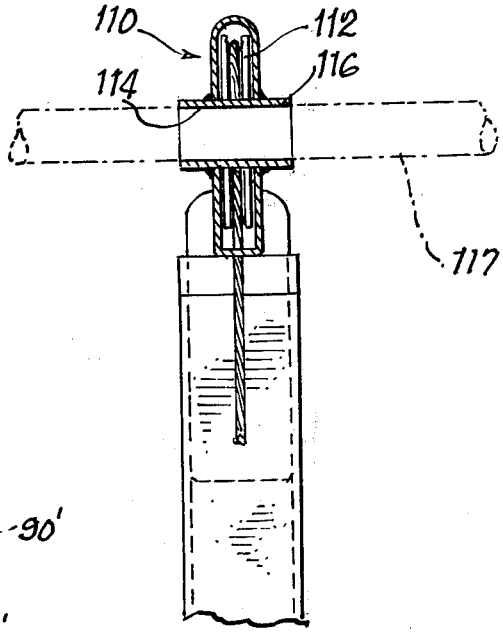
FIG. 10 is a view taken on line 10—10 of FIG. 9.
Figure 11:
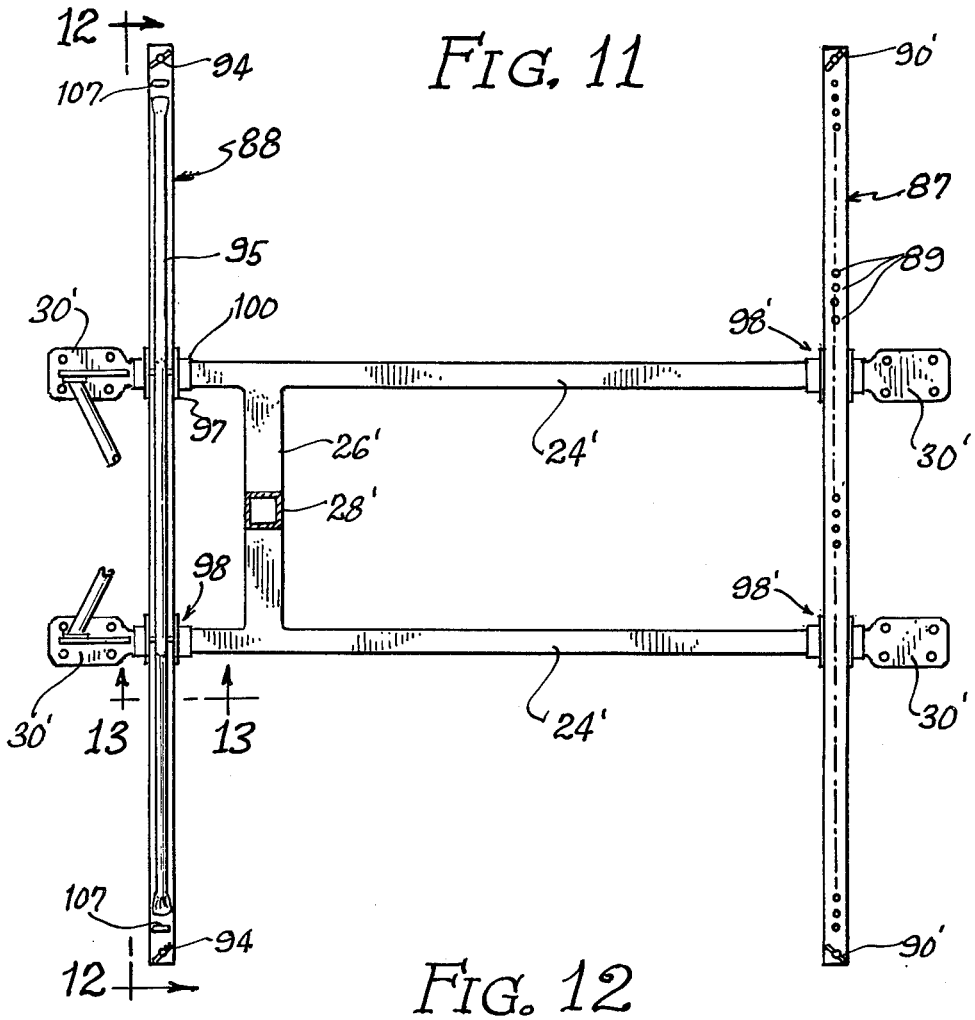
FIG. 11 is a top plan view taken on line 11—11 of FIG. 8, showing the base with the stationary outriggers.
Figure 12:
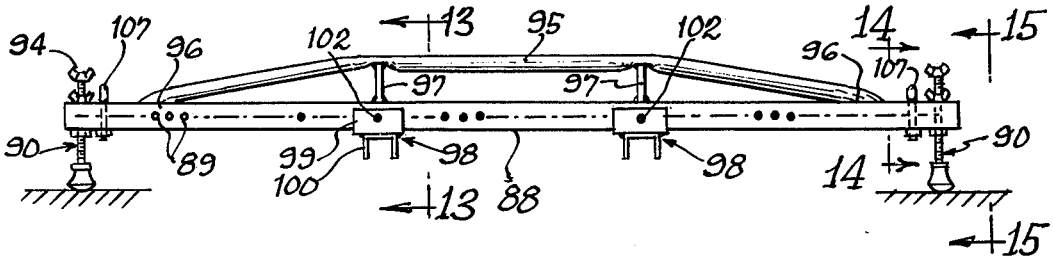
FIG. 12 is an elevational view taken on line 12—12 of FIG. 11.
Figure 13:
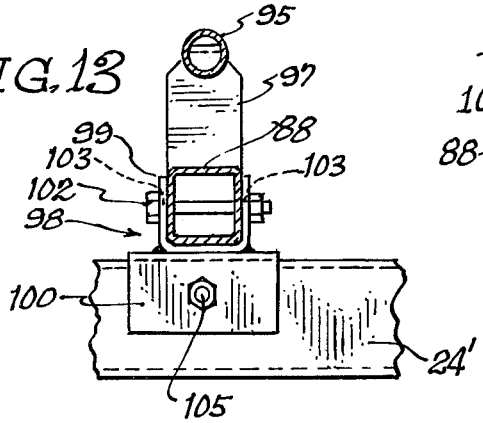
FIG. 13 is a view taken on line 13—13 of FIG. 12.
Figure 14:
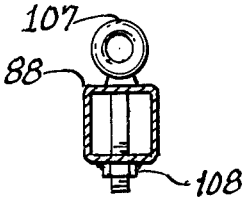
FIG. 14 is a view taken on line 14—14 of FIG. 12.
Figure 15:
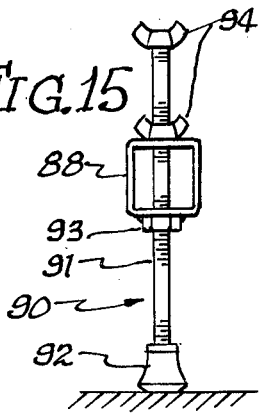
FIG. 15 is a view taken on line 15—15 of FIG. 12.

The modified pulley housing utilized in this modified structure is best shown in FIGS. 8, 9 and 10. The modified pulley housing is indicated generally at 110 and it supports a single pulley 112 which when the housing is secured to the vertical post 14' positions the single pulley in substantial vertical alinement with the post. The housing 110 extends rearwardly of said pulley and has a pair of alined openings 114 through which extends a sleeve or bushing 116 which is welded to the housing 110 and which is adapted for receiving a pipe or tubular member 117 to which scaffolding and the like may be attached. The housing 110 also has a pair of wedge locks generally indicated at 118 and the guy wire 120 is secured to each wedge lock, as best seen in FIG. 9. As best seen in FIG. 8, two guy wires 120 are secured to the pulley housing by means of the pair of wedge locks, with the lower ends of the guy wires 120 secured to turnbuckles 122 which are detachably connected to the eye bolts 107. The guy wires are tensioned to the desired tension by the turnbuckles 122. The guy wires incline outwardly from the top toward the bottom, as shown in FIG. 8, to provide additional support for a high post and they serve as a cantilever force to counterbalance the load on the load platform 22'.

What is claimed is:

1. A portable lift comprising, a base having a pair of spaced sides, an upright post supported on said base, said upright post formed of a plurality of detachable sections with the uppermost section having a hollow tubular end, a load supporting platform which includes a carriage member which surrounds the post and is slideably supported on said upright post and load supporting arms connected to said carriage and extending forwardly of said post, a pulley unit as a single integrally formed structure comprising an elongated pulley housing and a pulley within said housing and a coupling tongue detachably telescoping into said uppermost hollow tubular end for detachably securing said pulley unit to said upright post, said pulley housing extending rearwardly of said post and forming a cantilever and supporting said pulley within said housing in substantial vertical alinement with said post, a winch supported on said post intermediate the pulley housing and base and extending rearwardly of said post, a cable connected to said winch and extending over said pulley and extending forwardly and outwardly of said post and continuing downward and connected to said carriage of said load supporting platform so that operation of said winch will through said cable cause said load supporting platform to move up or down on said upright post, the portion of said cable extending rearwardly of the post between said pulley and said winch being at an inclined angle and providing a cantilever force which counterbalances the force of the load at the front of the lift and the portion of the cable extending forwardly of the post between the pulley and the carriage extending vertically, an outrigger secured to said base to extend laterally of both sides of said base, guy wires secured to said outrigger with the opposite ends secured to means on said pulley housing adjacent the rear of said pulley housing providing a cantilever force which counterbalances the force of the load at the front of the lift.

2. A portable lift comprising, a base, an upright post supported on said base, said upright post formed of a plurality of detachable sections with the uppermost section having a hollow tubular end, a load supporting platform which includes a carriage member which surrounds the post and is slidably supported on said upright post and load supporting arms connected to said carriage, said load supporting arms extending forwardly of said post, a pulley unit as a single integrally formed structure comprising an elongated pulley housing and first and second pulleys within said pulley housing, means for detachably securing said pulley unit to said uppermost post section, said pulley unit when secured to said post positioning said pulley housing so that a portion thereof extends rearwardly of said post and forms a cantilever, with said first pulley being in substantial vertical alinement with said post and the second pulley positioned rearwardly of said first pulley and with the axes of both said pulleys being in a common horizontal plane and with both pulleys having the same circumference, a winch supported on said post intermediate the pulley housing and base and extending rearwardly of said post, a cable connected to said winch and extending over both said pulleys and extending forwardly and outwardly of said post and continuing downwardly and connected to the carriage of said load supporting platform so that operation of said winch will through said cable cause said load supporting platform to move up or down on said upright post, the portion of said cable extending rearwardly of the post between said second pulley and said winch being at an inclined angle and providing a cantilever force which counterbalances the force of the load at the front of the lift and the portion of the cable extending forwardly of the post between the first pulley and the carriage extending vertically.

3. A portable lift as set forth in claim 2 in which the means on the pulley unit for detachably securing the pulley unit to the uppermost section comprises a coupling tongue which telescopes into the uppermost post section.

4. A portable lift as set forth in claim 2 in which an outrigger is pivotally mounted on each side of said base and is pivotally movable to extend laterally of each side of said base or parallel to said base, and means for locking each said outrigger in any of its pivoted positions relative to said base.

5. A portable lift as set forth in claim 4 in which the outrigger has a serrated surface engageable with a serrated surface on an ear extending laterally of said base, and means for locking said serrated surfaces relative to each other to prevent pivotal movement of the outrigger relative to the base.

6. A portable lift as set forth in claim 2 in which the base is supported on rollers and in which a wheel assembly including a pair of wheels is secured to the rear of said base and in which in a normal horizontal position of said base the wheels are positioned above the bottom plane of the rollers and only when the lift is tilted rearwardly will said wheels engage a floor or ground surface to permit the lift to be wheeled on said wheels.

* * * * *